United States Patent [19]

Bellinger

[11] 4,305,562

[45] Dec. 15, 1981

[54] OUTER CORNER EDGE HOLDER

[76] Inventor: Pitts N. Bellinger, 5465 Crown Ave., Charleston, S.C. 29406

[21] Appl. No.: 142,969

[22] Filed: Apr. 23, 1980

Related U.S. Application Data

[63] Continuation of Ser. No. 29,290, Apr. 12, 1979, Pat. No. 4,226,395.

[51] Int. Cl.[3] ..... A47M 1/10

[52] U.S. Cl. ..... 248/263; 248/255

[58] Field of Search ..... 248/251, 267, 261, 262, 248/266, 268, 269, 252, 254, 255, 257

[56] References Cited

U.S. PATENT DOCUMENTS

| | | | |
|---|---|---|---|
| 932,684 | 8/1909 | Depp | 248/254 |
| 1,012,369 | 12/1911 | Kolb | 248/267 |
| 1,326,424 | 12/1919 | Schaumloeffel | 248/252 |
| 1,370,817 | 3/1921 | Jackson | 248/254 X |
| 1,461,855 | 7/1923 | Kroesser | 248/262 |
| 1,571,760 | 2/1926 | Dick | 248/255 |
| 1,668,241 | 5/1928 | Grey | 248/254 |
| 1,752,743 | 4/1930 | Kall | 248/255 |
| 1,799,802 | 4/1931 | Marczukowski | 248/263 |
| 2,135,159 | 11/1938 | Zbock | 248/262 |
| 2,679,373 | 5/1954 | Henley | 248/267 X |

FOREIGN PATENT DOCUMENTS

| | | | |
|---|---|---|---|
| 523379 | 4/1956 | Canada | 248/255 |
| 545323 | 8/1957 | Canada | 248/262 |

*Primary Examiner*—J. Franklin Foss

*Attorney, Agent, or Firm*—Larry Harold Kline

[57] ABSTRACT

A holder is disclosed for supporting a rod on the corner of a structure comprising a rod support section and a securing section attached to the outer edge of the corner.

4 Claims, 8 Drawing Figures

OUTER CORNER EDGE HOLDER

This is a continuation, of application Ser. No. 029,290, filed Apr. 12, 1979 now U.S. Pat. No. 4,226,395.

This invention relates to a holder for hanging rods nd more particularly to a holder which can be secured without damaging the outer facing of the structure on which it is utilized.

In hanging rods for use with curtains, draperies and other window or door dressings, various holders may be utilized to secure the rods. The present invention is a holder which may be utilized to secure the rod which can be secured without damaging the exterior surface of the structure. Various modifications of this holder also form a part of this invention.

An object of the present invention is to secure a holder for rods on a structure without damaging the outside surface of the structure.

Another object of the present invention is to secure a holder onto the casing or trim of a door or window structure without damaging the facing of the door or window.

Still another object of the present invention is to secure a side-attached holder onto the casing or trim of a door or window structure without damaging the facing of the door or window.

A further object of the present invention is to secure a double side-attached holder onto the casing or trim of a door or window structure without damaging the facing of the door or window.

Another object of the present invention is to secure a single top-attached holder onto the casing or trim of a door or window structure without damaging the facing of the door or window.

Still another object of the present invention is to secure a double top-attached holder onto the casing or trim of a door or window structure without damaging the facing of the door or window.

A further object of the present invention is to secure a universal top-attached holder onto the casing or trim of a door or window structure without damaging the facing of the door or window.

Another object of the present invention is to secure a universal side-attached holder onto the casing or trim of a door or window structure without damaging the facing of the door or window.

A further object of the present invention is to secure a single combination side and top-attached holder onto the casing or trim of a door or window structure without damaging the facing of the door or window.

Still another object of the present invention is to secure a double combination side and top-attached holder onto the casing or trim of a door or window structure without damaging the facing of the door or window.

These and other objects and features of the invention will be apparent from the following description and appended claims.

Briefly, the invention is a holder for supporting a rod on the corner of a structure. The holder comprises securing means attached to the outer edge of the corner. A front support section attached to the securing means extends over a portion of the outer facing of the corner. A rod support section is attached to the front support section. A rod may be attached to the rod support section. The rod is supported on a holder by the holder being secured to the outer edge of the corner. The outer facing of the corner of the structure is not defaced by the securing means. The securing means may comprise a side support section secured to the front support section. A hole is within the side support section through which a fastener may secure the side support section to the side edge of the corner. A plurality of holes may be within the side support section through which a plurality of fasteners may be secured. The corner of the structure may be formed of two pieces joined at a seam. The ends of the plurality of fasteners do not reach the seam joining the pieces at the corner. A second rod support section may be secured to the front support section. A second rod may be secured on the second rod support section. The securing means may comprise a top support section. The securing means may comprise a top support section comprising a center section and two outer sections. The two outer sections may be separated from the center section by a plurality of tearing edges. Either one of the two outer sections may be removed in order to utilize the holder on either side of the structure. A hole may be within the center section and each of the two outer sections through which a fastener may secure the holder to the top edge of the corner. The securing means may comprise a right side support section and a left side support section, each separated from the front support section by a tearing edge. The right side support section may be severed to utilize the holder on the left side of the structure. The left side support section may be severed to utilize the holder on the right side of the structure. The securing means may comprise a side support section, a top support section and a support seam connecting the side and top support sections. The holder for supporting a rod on the corner of a structure may comprise securing means attached to the outer edge of the corner and a rod support section attached directly to the securing means. Any type of fastener may be used. Nails are shown and discussed herein. Screws, nails, or any other type fastener desired may be utilized.

The invention will be more fully understood from the following detailed description and appended claims when taken with the drawings in which:

Figure 1:
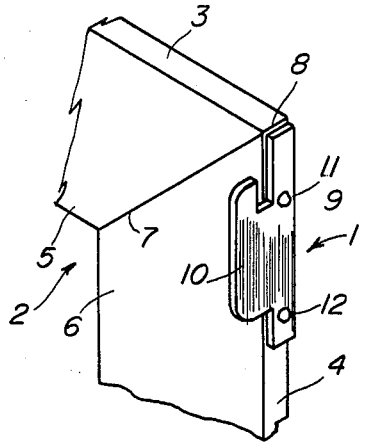
FIG. 1 is an isometric view of the side-attached holder placed on a corner of a window or door frame structure.

Referring now to the drawings, FIG. 1 is an isometric view of the side-attached holder placed on the corner of a window or door frame. The side-attached holder 1 is placed on corner 2 of a window or door frame. Corner 2 is formed of top trim 3, side trim 4, top trim facing 5 and side trim facing 6. Seam 7 is at the connection between top trim facing 5 and side trim facing 6. Seam 8 is between top trim 3 and side trim 4. Side-attached holder 1 comprises side support section 9, rod support section 10 and fastener holes 11 and 12. Nails are shown in fastener holes 11 and 12 which secure the side-attached holder 1 to the side trim 4 of corner 2. The fastener holes 11 and 12 are placed onto side support section 9 of side-attached holder 1 so that fasteners placed into fastener holes 11 and 12 will not reach seam 7. Rods may be attached onto rod support section 10 of side-attached holder 1 without the outer facing, top trim facing 5 and side trim facing 6, being damaged or marred in any way. If a later decision were made to remove side-attached holder 1, there would be no damage to the facing of corner 2. Shown in the figures is a holder for the right corner of the structure, facing the structure. The same side-attached holder 1 is applicable for the left corner of the structure.

Figure 2:
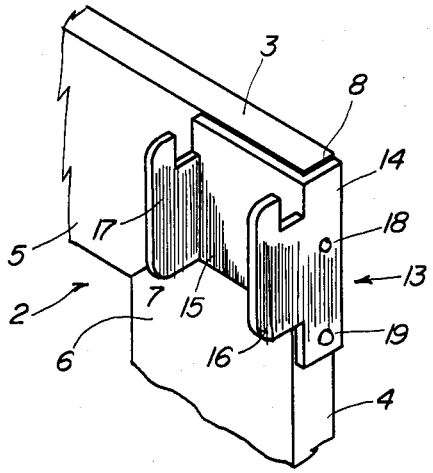
FIG. 2 is an isometric view of the double side-attached holder placed on a corner of a window or door frame structure.

FIG. 2 is an isometric view of the double side-attached holder placed on the corner of a window or door frame. The double side-attached holder 13 is placed on corner 2 of a window or door frame. Corner 2 is formed of top trim 3, side trim 4, top trim facing 5 and side trim facing 6. Seam 7 is at the connection between top trim facing 5 and side trim facing 6. Seam 8 is between top trim 3 and side trim 4. Double side-attached holder 13 comprises side support section 14, front support section 15, rod support sections 16 and 17 and fastener holes 18 and 19. Nails are shown in fastener holes 18 and 19 which secure the double side-attached holder 13 to the side trim 4 of corner 2. The fastener holes 18 and 19 are placed onto side support section 14 of double side-attached holder 13 so that fasteners placed into fastener holes 18 and 19 will not reach seam 7. Rods may be attached onto rod support sections 16 and 17 of double side-attached holder 13 without the outer facing, top trim facing 5 and side trim facing 6, being damaged or marred in any way. If a later decision were made to remove double side-attached holder 13, there would be no damage to the facing of corner 2. Shown in the figures is a holder for the right corner of the structure, facing the structure. The double side-attached holder 13 may be utilized for the left corner of the structure by securing side support section 14 to the opposite side of front support section 15.

Figure 3:
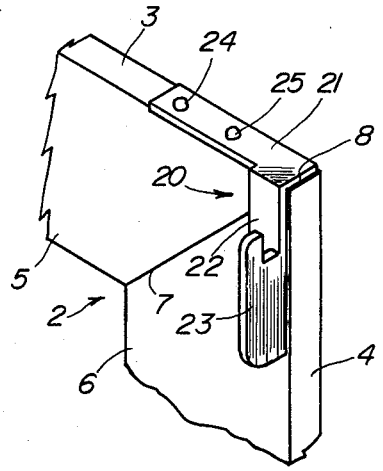
FIG. 3 is an isometric view of the single top-attached holder placed on a corner of a window or door frame structure.

FIG. 3 is an isometric view of the single top-attached holder placed on the corner of a window or door frame. The single top-attached holder 20 is placed on corner 2 of a window or door frame. Corner 2 is formed of top trim 3, side trim 4, top trim facing 5 and side trim facing 6. Seam 7 is at the connection between top trim facing 5 and side trim facing 6. Seam 8 is between top trim 3 and side trim 4. Single top-attached holder 20 comprises top support section 21, front support section 22, rod support section 23 and fastener holes 24 and 25. Nails are shown in fastener holes 24 and 25 which secure the single top-attached holder 20 to the side trim 4 of corner 2. The fastener holes 24 and 25 are placed onto top support section 21 of single top-attached holder 20 so that fasteners placed into fastener holes 24 and 25 will not reach seam 7. Rods may be attached onto rod support section 23 of single top-attached holder 20 without the outer facing, top trim facing 5 and side trim facing 6, being damaged or marred in any way. If a later decision were made to remove single top-attached holder 20, there would be no damage to the facing of corner 2. Shown in the figures is a holder for the right corner of the structure, facing the structure. The single top-attached holder 20 may be utilized for the left corner of the structure by removing the left portion of the top support section 21 and adding another support section to the right of the present top section 21.

Figure 4:
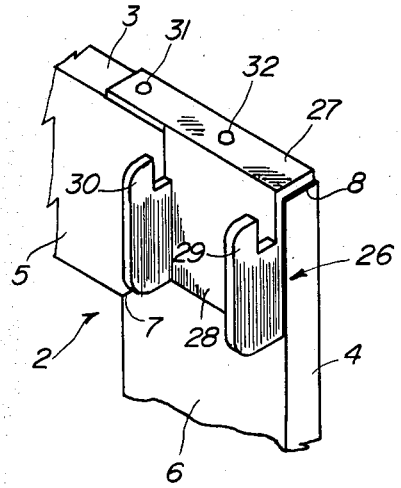
FIG. 4 is an isometric view of the double top-attached holder placed on a corner of a window or door frame structure.

FIG. 4 is an isometric view of the double top-attached holder placed on the corner of a window or door frame. The double top-attached holder 26 is placed on corner 2 of a window or door frame. Corner 2 is formed of top trim 3, side trim 4, top trim facing 5 and side trim facing 6. Seam 7 is at the connection between top trim facing 5 and side trim facing 6. Seam 8 is between top trim 3 and side trim 4. Double top-attached holder 26 comprises top support section 27, front support section 28, rod support sections 29 and 30 and fastener holes 31 and 32. Nails are shown in fastener holes 31 and 32 which secure the double top-attached holder 26 to the side trim 4 of corner 2. The fastener holes 31 and 32 are placed onto top support section 27 of double top-attached holder 26 so that fasteners placed into fastener holes 31 and 32 will not reach seam 7. Rods may be attached onto rod support sections 29 and 30 of double top-attached holder 26 without the outer facing, top trim facing 5 and side trim facing 6, being damaged or marred in any way. If a later decision were made to remove double top-attached holder 26, there would be no damage to the facing of corner 2. Shown in the figures is a holder for the right corner of the structure, facing the structure. The double top-attached holder 26 may be utilized for the left corner of the structure by removing the left portion of the top support section 27 and adding another support section to the right of the present top support section 27.

Figure 5:
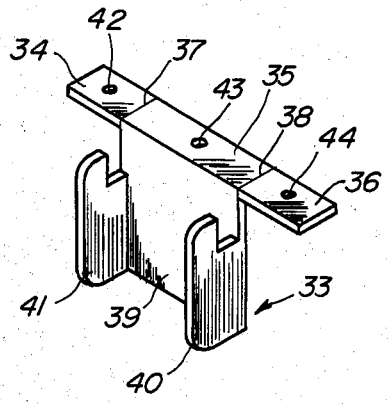
FIG. 5 is an isometric view of the universal either end of top-attached holder for use on a corner of a window or door frame structure.

FIG. 5 is an isometric view of the universal either end of the top-attached holder for use on a window or door frame. The universal either end of the top-attached holder 33 is placed on a corner of a window or door frame, as in FIGS. 1–4. The corner 2 in FIGS. 1–4 is not shown. The universal either end of the top-attached holder 33 is used similarly to the double top-attached holder shown previously in FIG. 4. The universal either end of the top-attached holder 33 comprises a front support section 39 and supporting rod support sections 40 and 41. The top support section connected to the front support section comprises left section 34, center section 35 and right section 36. Between left section 34 and center section 35 is tearing edge 37. Tearing edge 38 is between center section 35 and right section 36. Fastener hole 42 is in left section 34, fastener hole 43 is in center section 35 and fastener hole 44 is in right section 36. The universal either end of the top-attached holder 33 can be manufactured to be utilized at either end of the top of a structure. Facing the structure, right section 36 can be severed at tearing edge 38 in order to utilize the universal either end of the top-attached holder 33 for a left corner holder. Facing the structure, left section 34 can be severed at tearing edges 37 in order to utilize the universal either end of the top-attaching holder 33 for a right corner holder. The fastener holes 42, 43 and 44 are placed onto the top support sections 34, 35 and 36 of universal either end of the top-attached holder 33 so that fasteners placed into fastener holes 42, 43 and 44 will not reach the seam of the corner. Rods may be attached onto rod support sections 40 and 41 of universal either end of the top-attached holder 33 without the outer facing, top trim facing 5 and side trim facing 6, being damaged or marred in any way. If a later decision were made to remove universal either end of the top-attached holder 33, there would be no damage to the facing of corner 2. The double universal either end of the top-attached holder could be a single universal either end of the top-attached holder, if desired.

Figure 6:
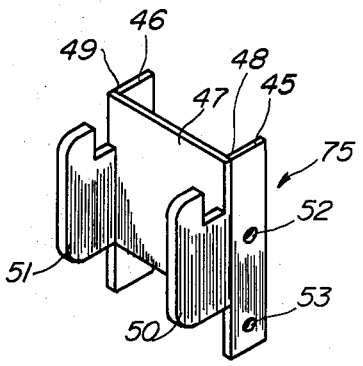
FIG. 6 is an isometric view of the universal either end of side-attached holder for use on a corner of a window or door frame structure.

FIG. 6 is an isometric view of a universal either side-attached holder for use on a window or door frame. The universal either side-attached holder is placed on a corner of a window or door frame, as in FIGS. 1–4. The corner 2 in FIGS. 1–4 is not shown. The universal either side-attached holder comprises right support section 45, left support section 46, front support section 47 and rod support sections 50 and 51. Tearing edge 48 is between right side support section 45 and front support section 47. Tearing edge 49 is between left support section 46 and front support section 47. Fastener holes 52 and 53 are shown on right side support section 45. Fastener holes similar to fastener holes 52 and 53 are on left side support section 46, but are not shown. Facing the structure, right side support section 45 can be severed at tearing edge 48 in order to utilize the universal either side-attached holder for a left corner holder. Facing the structure, left side support section 46 can be severed at tearing edge 49 in order to utilize the universal either side-attached holder for a right corner holder. The fastener holes 52 and 53, and those not shown, are placed onto side support sections 45 and 46 of universal either side-attached holder so that fasteners placed into fastener holes 52 and 53, and those not shown, will not reach seam 7. Rods may be attached onto rod support sections 50 and 51 of universal either side-attached holder without the outer facing, top trim facing 5 and side trim facing 6, being damaged or marred in any way. If a later decision were made to remove universal either side-attached holder, there would be no damage to the facing of corner 2. If desired, the double universal either side-attached holder shown could be a single universal either side-attached holder.

Figure 7:
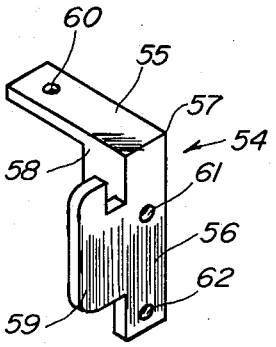
FIG. 7 is an isometric view of the single combination side and top-attached holder for use on a corner of a window or door frame structure.

FIG. 7 is an isometric view of a single combination side and top-attached holder for use on a window or door frame. The single combination side and top-attached holder is placed on a corner of a window or door frame, as in FIGS. 1–4. The corner 2 in FIGS. 1–4 is not shown. The single combination side and top-attached holder 54 comprises a top support section 55, side support section 56, front support section 58 and rod support section 59. Top support section 55 and side support section 56 meet at support seam 57. Top support section 55 has a top fastener hole 60. Side support section 56 has side fastener holes 61 and 62. Single combination side and top-attached holder 54 is appropriate for situations in which greater support may be desired, giving support from the top and side. The fastener holes 60, 61 and 62 are placed onto support sections 55 and 56 of single combination side and top-attached holder 54 so that fasteners placed into fastener holes 60, 61 and 62 will not reach seam 7. Rods may be attached onto rod support section 59 of single combination side and top-attached holder 54 without the outer facing, top trim facing 5 and side trim facing 6, being damaged or marred in any way. If a later decision were made to remove single combination side and top-attached holder 54, there would be no damage to the facing of corner 2.

Figure 8:
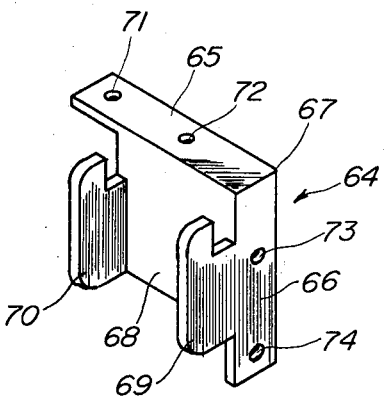
FIG. 8 is an isometric view of the double combination side and top-attached holder for use on a corner of a window or door frame structure.

FIG. 8 is an isometric view of a double combination side and top-attached holder for use on a window or door frame. The double combination side and top-attached holder is placed on a corner of a window or door frame, as in FIGS. 1–4. The corner 2 in FIGS. 1–4 is not shown. The double combination side and top-attached holder 64 comprises a top support section 65, side support section 66, front support section 68 and rod support section 69. Top support section 65 and side support section 66 meet at support seam 67. Top support section 65 has top fastener holes 71 and 72. Side support section 66 has side fastener holes 73 and 74. Double combination side and top-attached holder 64 is appropriate for situations in which greater support may be desired, giving support from the top and side. The fastener holes 71, 72 and 73 are placed onto support sections 65 and 66 of double combination side and top-attached holder 64 so that fasteners placed into fastener holes 71, 72 and 73 will not reach seam 7. Rods may be attached onto rod support sections 69 and 70 of double combination side and top-attached holder 64 without the outer facing, top trim facing 5 and side trim facing 6, being damaged or marred in any way. If a later decision were made to remove double combination side and top-attached holder 64, there would be no damage to the facing of corner 2.

The present invention has been shown with many variations. The primary function of the present invention is to support rods, or hangers, without marring or defacing the front surface of a structure. Present-day supports tend to mar, scar and deface the beauty of the outer facing of the corners of window trim and door frames.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A holder for supporting a rod on a corner of a structure comprising:

(a) securing means attached to the outer edge of said corner;

(b) a front support section attached to said securing means and extending over a portion of the outer facing of said corner;

(c) a rod support section attached to said front support section operative to have said rod attached thereto;

whereby said rod is supported on said holder by said holder being secured to said outer edge of said corner, thereby not defacing, with said securing means, said outer facing of said corner of said structure with securing means;

wherein said securing means comprises a top support section secured to said front support section, said top support section comprising a center section and two outer sections, each separated from said center section by a tearing edge;

whereby either one of said two outer sections may be removed in order to utilize said holder on either side of said structure;

wherein said securing means comprises:

(d) a right side support section secured to said front support section;

(e) a left side support section secured to said front support section;

(f) a first tearing edge between said right side support section and said front support section; and (g) a second tearing edge between said left side support section and said front support section;

whereby said right side support section may be severed at said first tearing edge to utilize said holder on the left side of said structure; and whereby said left side support section may be severed at said second tearing edge in order to utilize said holder on the right side of said structure.

2. A holder according to claim 1 further comprising a hole within said right side support section through which a fastener may secure said right side support section to the right side edge of said corner, and a hole within said left side support section through which a fastener may secure said left side support section to the left side edge of said corner.

3. A holder according to claim 1 wherein a plurality of holes is within said right side support section and said left side support section through which a plurality of fasteners may be secured, wherein the corner of said structure is formed of two pieces joined at a seam, and wherein the ends of said plurality of fasteners do not reach said seam joining said pieces at said corner.

4. A holder according to claim 3 further comprising a second rod support section secured to said front support section, operative to support a second rod on said corner of said structure.

* * * * *